US005228490A

United States Patent [19]

Wolf

[11] Patent Number: 5,228,490

[45] Date of Patent: Jul. 20, 1993

[54] PROCESS AND APPARATUS FOR PRODUCING SQUARES FROM TREE BOLES OR THE LIKE

[76] Inventor: Johann Wolf, Muhldorf 86, A-4644 Scharnstein (Oberosterreich), Austria

[21] Appl. No.: 867,528

[22] Filed: Apr. 13, 1992

[30] Foreign Application Priority Data

May 14, 1991 [AT] Austria ..... 997/91

[51] Int. Cl.[5] ..... B27B 1/00

[52] U.S. Cl. ..... 144/357; 83/360; 83/365; 83/371; 83/708; 144/3 R; 144/39; 144/377; 144/378; 269/308

[58] Field of Search ..... 269/308; 83/360, 365, 83/371, 708; 144/3 R, 3 P, 39, 356, 357, 370, 373, 375, 377, 378

[56] References Cited

U.S. PATENT DOCUMENTS

| | | | |
|---|---|---|---|
| 4,440,203 | 4/1984 | Ostberg | 144/39 |
| 4,548,247 | 10/1985 | Eklund | 144/39 |
| 4,572,256 | 2/1986 | Rautio | 144/39 |
| 4,750,535 | 6/1988 | Wolf | 144/39 |
| 4,772,001 | 9/1988 | Hurdle, Jr. . | |
| 4,794,964 | 1/1989 | Wolf | 144/39 |
| 4,867,213 | 9/1989 | Bolton et al. | 144/359 |
| 4,907,632 | 3/1990 | Reuter | 144/39 |
| 4,947,909 | 8/1990 | Stroud | 144/39 |

FOREIGN PATENT DOCUMENTS

| | | |
|---|---|---|
| 365505 | 1/1982 | Australia . |
| 382106 | 1/1987 | Australia . |
| 0286701 | 10/1988 | European Pat. Off. . |
| 1403685 | 7/1969 | Fed. Rep. of Germany . |
| 3048753 | 7/1982 | Fed. Rep. of Germany . |
| 3114843 | 10/1982 | Fed. Rep. of Germany . |
| 3730865 | 3/1989 | Fed. Rep. of Germany . |

OTHER PUBLICATIONS

"Die Einschnitt-Zentren von Wurster & Dietz", L8302.

*Primary Examiner*—Donald Bray
*Attorney, Agent, or Firm*—Young & Thompson

[57] ABSTRACT

A process for producing beams of square cross-section from tree boles or the like is characterized in that plano-convex slabs are severed in parallel to the hart zone of the boles. An apparatus for performing the process is characterized in that the boles (2) are supported by height-adjustable supports (9, 10) in such a way that the heart zone (8) is congruent with the preferably horizontal feeding direction of the bole (2). Thereby, the thus-produced square beam (7) is defined by planes parallel to the heart zone.

17 Claims, 3 Drawing Sheets

PROCESS AND APPARATUS FOR PRODUCING SQUARES FROM TREE BOLES OR THE LIKE

Figures 1, 2, 3, 4:
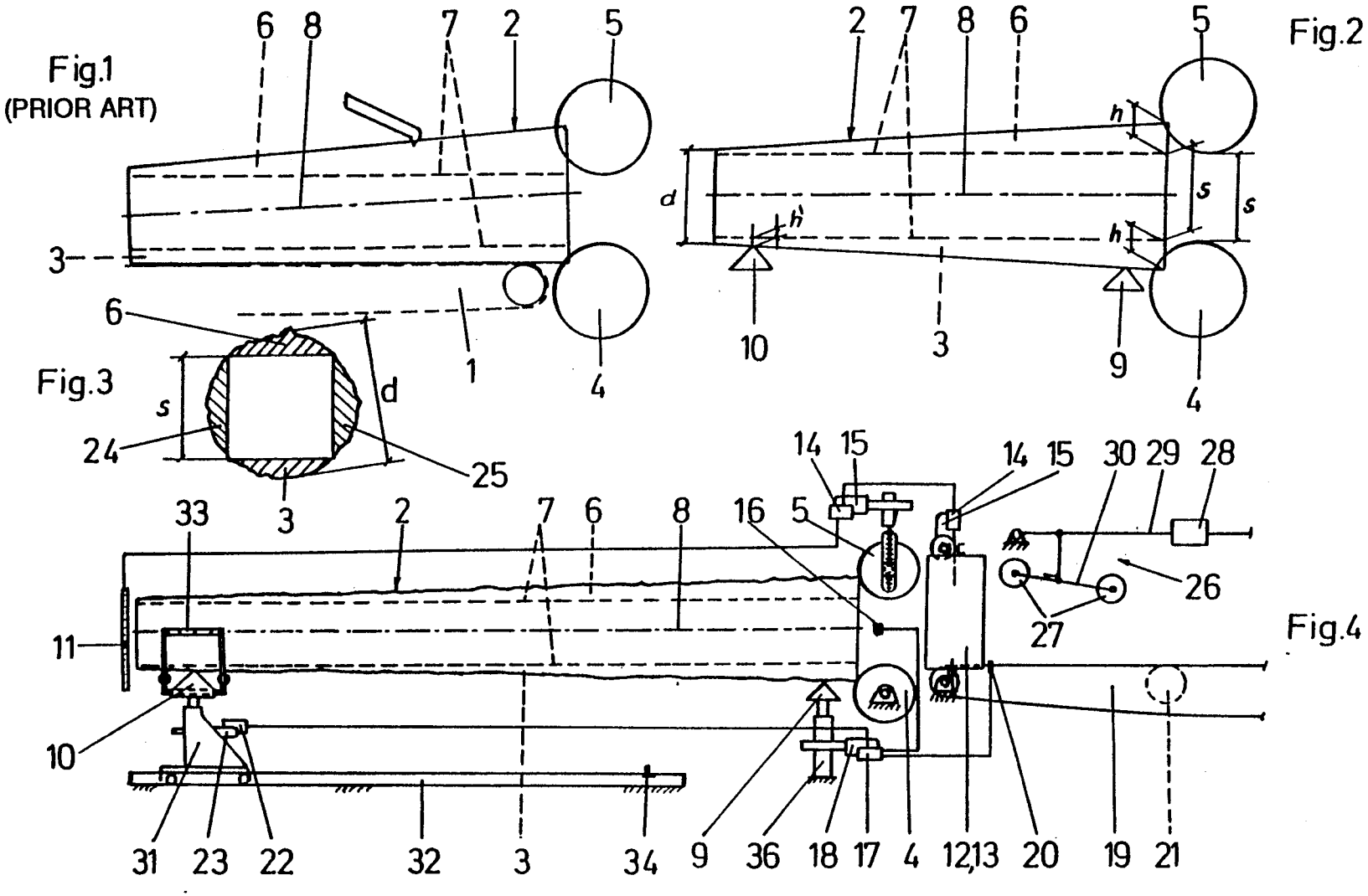
Fig.1 (PRIOR ART)

The invention relates to a process and an apparatus for the production of squares from tree boles or the like in a continuous procedure wherein the boles are fed preferably transversely to a machining line, and passed on, after traveling through removal tools, to a saw for further processing into boards, planks or beams. Such edging machines, processing varying boles in rapid transit into squares, facilitate the further breakdown into boards and beams and the like quite substantially since the thus-prepared squares exhibit planar supporting areas and parallel sides.

Continuous machines performing such a four-sided machining operation are conventional. In these systems, the bole is urged by means of hold-downs onto a chain conveyor and guided in this way through the machining tools. The latter consist of rotary milling cutters (chippers) revolving in pairs about horizontal and vertical axes and removing the barrels (rounded portions) of the boles. The lateral guidance of the boles is performed upstream of the tools by the chain conveyor and the accompanying hold-down and, downstream of the tools, i.e. on the outlet side, by the machined underside of the bole. The lower horizontal milling cutter exhibits centrally a narrow shoulder with a smaller diameter so that the exiting bole exhibits a projecting stem on its underside finding an associated guidance in the chain conveyor. At some distance from the tools (after an adequate guiding distance), this projecting stem is removed by means of a small rotary milling cutter. These conventional machines exhibit high throughput efficiencies, but they have the drawback that the boles are not machined in heart-parallel fashion. This means that, on the supported side facing the chain conveyor, the barrel is cut off in parallel to the contour generatrix of the bole, and on the topside of the latter a wedge-shaped barrel is removed increased by the conicity of the bole. The thus-manufactured square therefore has an obliquely extending heart, and the boards, beams or the like made therefrom exhibit cuts oriented obliquely to the grain, tending toward splintering.

The invention is based on the object of indicating a process and an apparatus permitting the production of squares from tree boles or the like wherein the boards, planks and beams made therefrom do not exhibit the above-discussed disadvantages.

The essential feature of the process of this invention resides in that the barrels are cut off in parallel to the heart zone of the boles.

The apparatus destined for performing the process of this invention is essentially characterized in that the boles are supported by vertically adjustable supports in such a way that the heart zone is congruent with the preferably horizontal feeding direction of the bole, and the thus-produced square is defined by planes in parallel to the heart zone.

Figure 5:
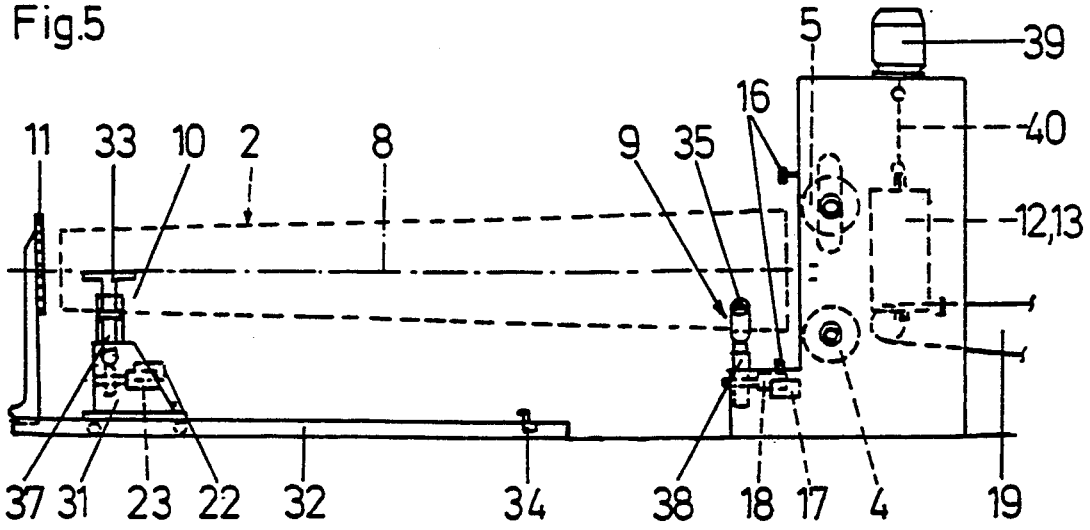
Figure 6:
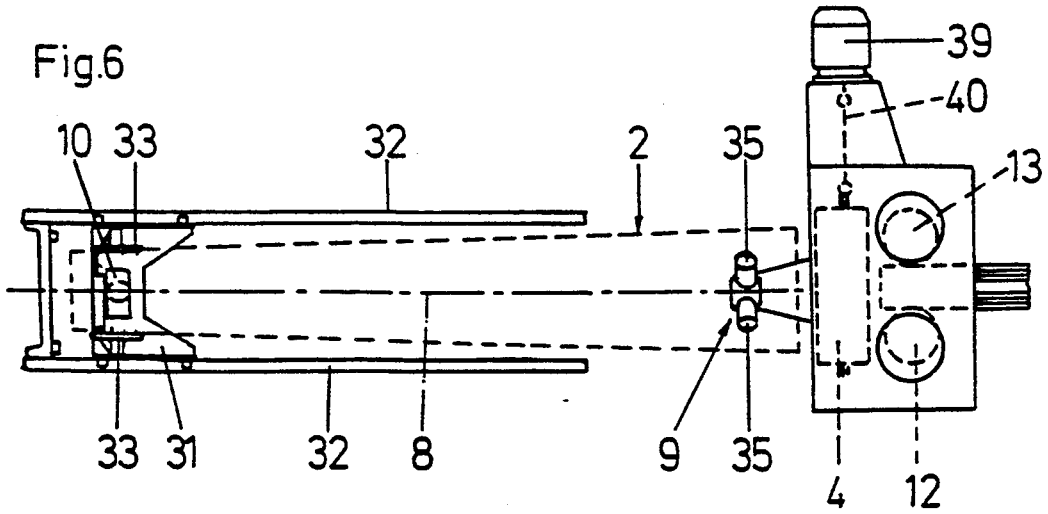
Figure 7:
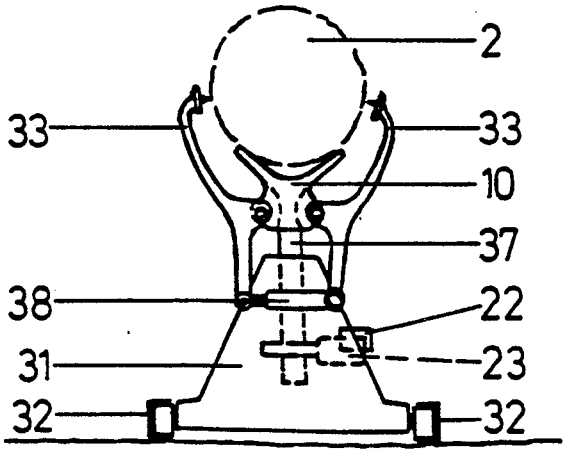
Figure 8:
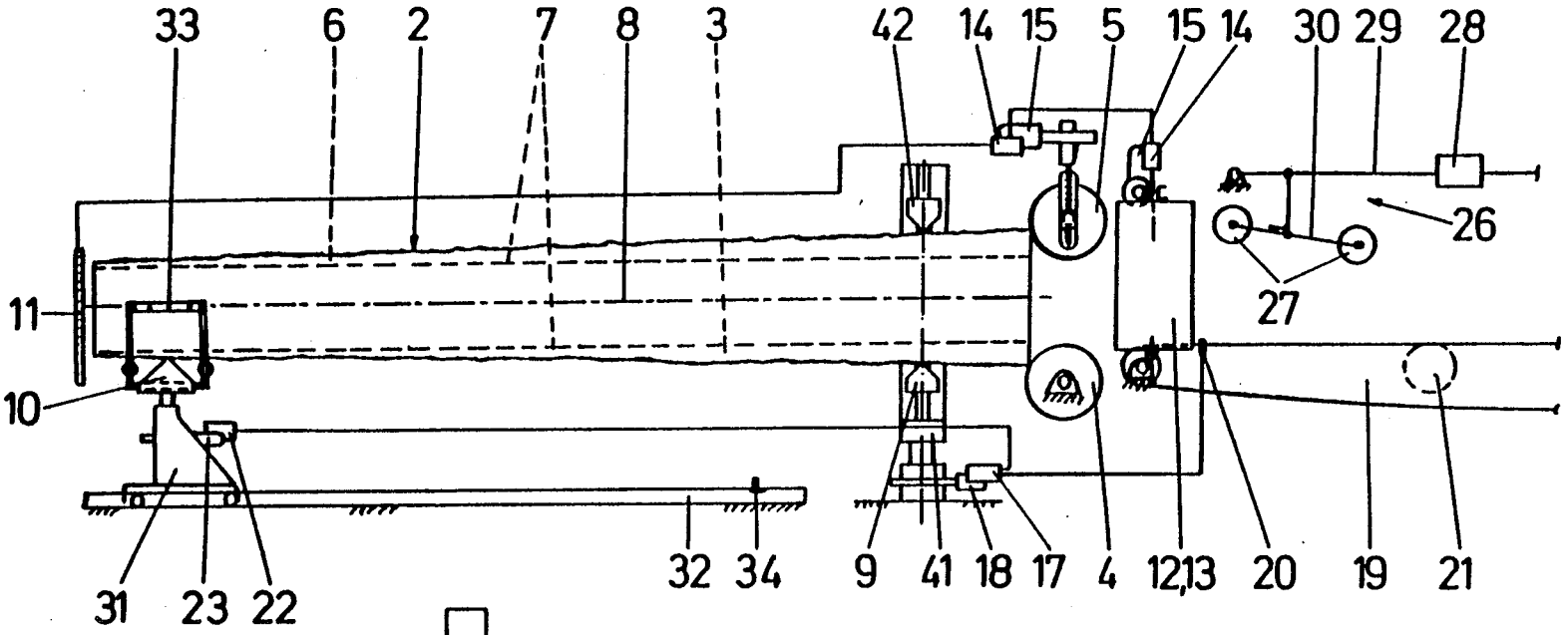
Figure 9:
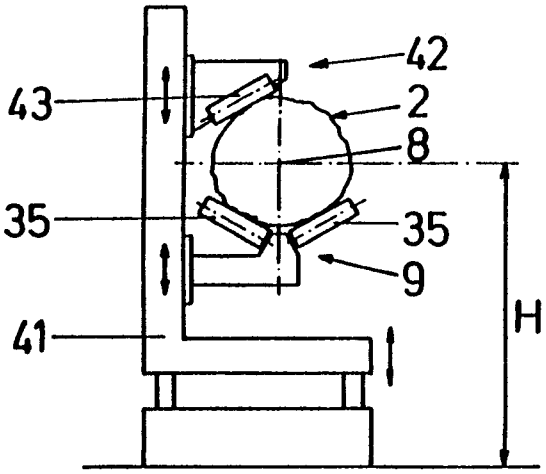

Details of the invention can be derived from the dependent claims and the following description with reference to the drawings, representing schematic views, wherein:

FIG. 1 shows the milling of squares in accordance with the presently known state of the art, FIG. 2 shows the desired heart-parallel machining of a bole, FIG. 3 shows the end face of a bole with the square drawn into the illustration, and the barrels to be removed being shown in shaded lines, FIG. 4 shows schematically the apparatus for producing heart-parallel cuts, FIGS. 5 and 6 show a practical embodiment of the apparatus in lateral view and top view, FIG. 7 shows a rear view of the support on the tail side of the log, FIG. 8 shows another embodiment of the apparatus according to the invention, and FIG. 9 shows an elevational view of the support on the head side of FIG. 8.

It can be seen from FIG. 1 that a barrel 3 is severed by a bottom milling roll 4 from a bole 2 resting on a chain conveyor 1 whereby the barrel 3 has boundaries in parallel to the chain conveyor 1, whereas a top milling roll 5 cuts off a conically bounded barrel 6. In the thus-produced square 7, the heart zone 8 of the log 2 is thus located obliquely to the longitudinal extension of the square 7. This results in the disadvantages described in the introduction.

FIG. 4 illustrates that the boles, fed preferably laterally via chain conveyors in stepwise fashion, drop on the head and tail sides into fork-shaped supports 9 and 10 whereby centering of the longitudinal sides is effected. After the bole 2 has assumed its position in the supports 9 and 10, the tail diameter d (FIG. 3) is directly determined by means of a light barrier 11, and this value is divided by 2 in a computer, resulting in the lateral length S of the square 7 to be produced. The thus-determined side length S on the tail side corresponds to $S+2h$ on the head side, h being the height of the barrel to be removed on the head side (FIG. 2). The values determined for S are converted into pulses or adjustment increments. When choosing these adjustment increments, it is to be taken into account that boles are never entirely straight, are never uniform, and exhibit knots and intergrowths in irregular arrangement; thus, nature sets limits for the accuracy. The thus-determined S value is then set on the head side by means of incremental displacement transducers and servomotors as the inside spacing between the horizontal and vertical rotary milling cutters 4, 5, 12, 13. At the same time, the head end is measured by a further light barrier 16, and the value h is determined by means of computer from $D-S=2h$. This value h is likewise passed on to the support 9 on the head side by way of an incremental displacement transducer 17 and servomotor 18, the support being adjusted at a distance h below the top edge of the bottom milling roll 4 (FIGS. 2 and 4). This setting perforce also results in an engagement having the height h for the top milling roll 5. In this way, a symmetrical barrel removal 3 and 6 has been set at the head end at the four sides of the tree bole. Once the bole 2 has been advanced to such an extent that the square 7 rests on a chain conveyor 19, the support 9 on the head side is lowered by way of a probe finger 20.

In order to ensure the symmetrical removal over the entire length of the bole 2 and thus to ensure a heart-parallel machining, the support 10 on the tail side must be adjusted together with the support 9 on the head side so that the heart zone of the bole 2 is guided in parallel to the support on the chain conveyor 19. Adjustment of the support 10 at the tail end can take place jointly with and in dependence on the support 9 on the head end if one assumes that the conicity of a bole 2 exhibits, with a specific length, a naturally given value. The support 10 on the tail side is thus to be placed in all cases higher by one-half the conicity than the support 9 on the head side. Accordingly, the value for setting one-half the conicity can be derived empirically or, alternatively, can be corrected correspondingly after several boles have passed through.

Coupling of the adjustment of the supports 9 and 10 on the head and tail sides can be brought about by mechanical transmission means or by differentiated adjusting motors 18 and 23.

The lateral barrels 24, 25 (FIG. 3) of the bole 2 are removed by the two perpendicularly arranged rotary milling cutters 12, 13 arranged subsequently to the horizontal rotary milling cutters 4, 5.

Adjustment of these cutters to the passage S takes place simultaneously and/or synchronously with the S adjustment of the upper horizontal rotary milling cutter 5.

On the delivery side (outlet side), the exiting square 7 is taken over by the chain conveyor 19 with associated hold-downs 26 wherein the topside of the chain conveyor, constituting the bearing, lies at the same level as the top edge of the bottom milling roll 4 fixedly mounted in the frame. The hold-down 26 carries rollers 27 on a rocker arm 30, the rocker arm 30 being articulated to a lever 29 on which a counterweight 28 is displaceably arranged. A subsequent saw for further machining into boards etc. accepts the exiting squares 7. In place of the subsequently arranged saw, it is also possible to provide an ejection and/or delivery device with lateral discharge.

The support 10 on the tail side is supported in a slide 31 guided in rails 32 which extend in parallel to the chain conveyor 19. The slide 31 is guided back and forth in the rails 32 by mechanical or hydraulic drive means. This rail-type guidance, occupying about two-thirds of the length of the longest bole 2 to be machined, ensures the linear guidance of the cutting operation, as seen in lateral view as well as top view. Grippers 33 operable by a hydraulic unit 38 are provided on both sides at a spacing above the tail-side support 10; these grippers laterally seize the bole 2 and firmly connect the latter with the slide 31. After a selectable feed path of the slide 31 by means of an adjustable stop 34 on the rails 32, the grippers 33 are hydraulically disengaged and simultaneously the slide 31 is returned into its initial position. The slide 31 accordingly takes over the feeding of the bole 2 along about two-thirds of its length while the residual length of the feeding distance is taken over by the chain conveyor 19 on the outlet side and the hold-down 26. The feeding speeds of the slide 31 and of the chain conveyor 19 are correspondingly adapted to each other. The linear guidance, as seen in top view (FIG. 6), is conducted either by a subsequently arranged roll pair, located at a spacing from the perpendicular milling rolls 12, 13, or by a stem remaining in the exiting square 7 and being guided in the chain conveyor 19; this stem is removed, at a spacing from the vertical milling rolls, by a small rotary milling cutter 21.

In order to avoid an excessive variety of different side lengths S of the squares 7, the computer is programmed so that the calculated values for the sides are rounded up or down, for example, to whole centimeter values. For example, if the calculated side value is 18.6 cm, this value is displayed by the computer as 19 cm, or a calculated value of 20.3 cm is displayed as being 20 cm, correspondingly rounded off.

The support 9 on the head side consists, in accordance with FIGS. 5 and 6, of rollers 35 with bifurcate mounting or of chains revolving over bifurcate bearing members. The fork exhibits a perpendicular guide element 36 so that the fork can be adjusted within limits in its vertical position by means of servomotor 18. The lower milling roll 4 is fixedly supported in the frame wherein also the chain conveyor 19 is mounted, and the top edge of the roll forms one plane with the surface of the chain. The adjustable milling rolls 5, 12, 13 are guided in a slide guide means and axially in parallel and are adjusted by servomotors 15 having self-locking threaded spindles. Also the support 10 on the tail side is of bifurcate structure, and the fork with the grippers 33 has a joint vertical guide 37 in the longitudinally displaceable slide 31. The vertical adjustment likewise takes place by means of a servomotor 23 which latter is adjusted as described above by the computer by way of displacement transducer 22 in accordance with the respective value $h' = d - S$ divided by 2.

The functional operation commences immediately once a trunk 2 has been inserted in the bifurcate cradles 9 and 10. The light measurement determines, in fractions of a second, the diameters and transmits the data practically without time loss to the computer which latter determines the values S and h and, respectively, h' and transmits these data via incremental displacement transducers to the servomotors. The entire adjusting process is performed within 1–2 seconds. Once the support 10 on the tail side has reached its assigned setting, the hydraulically operated gripper 33 is closed. The pressure rise occurring upon closing of the gripper activates the feed of the slide 31, and the bole 2 passes through the rotary milling cutters 4, 5, 12, 13 with about 3–2 m/sec. When the square 7 has left the perpendicular milling rolls 12, 13, the upper horizontal milling roll 5, the two perpendicularly guided milling rolls 12, 13, and the supports 9, 10 are returned into a zero position to which the incremental displacement transducer is set. This zero position can be set at the displacement transducer 17, 22 and is dependent on the minimum diameter D of the bole 2 to be machined. The milling tools can be switched independently of the control procedure and remain in operation during the control process. In order to avoid stressing the servomotors by the heavy drive motors 39 of the milling rolls 4, 5 and 12, 13, they are fixedly mounted to the frame at a spacing from the milling rolls, and power transmission is effected by means of universal-joint shafts 40.

The above-described arrangement with light measurement, computer, and displacement transducer for controlling a heart-parallel removal by the milling rollers results in an automatic progression of the machining operation and the operator exercises predominantly a monitoring function so that unskilled personnel can be employed for this purpose.

In order to avoid the device 16 at the head side for light measurement, which device is difficult to accommodate and can easily be interfered with by flying chips, the unit illustrated in FIGS. 8 and 9 is suggested, by means of which control is likewise simplified.

The unit illustrated in FIGS. 8 and 9 has an additional advantage over the aforedescribed devices, namely that the conicity of the bole is automatically compensated for during the adjustment of the supports 9 and 10. For this purpose, the device includes a support bearing 41 adjustable in its height. At the support bearing 41, the support 9 is displaceably guided with two rollers 35 arranged in a V shape and in rotatable fashion, and a slide 42 is displaceably guided at this bearing with a rotatably supported roller 43. The essential feature in this connection resides in that the support 9 and the slide 42 are moved synchronously toward each other and, respectively, away from each other so that a bole 2 is automatically centered always at a specific level on the support bearing 41, with the support 9 and the slide 42 moving toward each other, as illustrated in the exemplary embodiment of FIG. 9.

Once a bole 2 has been inserted in the bifurcate supports 9 and 10 (the support 9 and the slide 42 being in their mutually spaced-apart position), the diameter d of the tail end is determined by the light barrier 11 and transmitted to the computer which latter determines the values S and h'. From these values, the value H can be determined, i.e. the height of the heart zone 8 above a reference plane, e.g. the floor or the plane formed by the top edge of the roll 4 and the conveying surface of the conveyor 19 (in this case, $H=S/2$). The value H identical at the tail end and at the foot end of the bole 2 can now be employed for height adjustment of the tail-end support 10 as well as of the support bearing 41.

At the same time, the support 9 and the slide 42 move toward each other until the roller 43 of the slide 42 comes into contact with the bole 2 and the head end of the bole 2 is automatically centered at the level H, set at the support bearing 41.

It can be seen that, on account of this embodiment of the invention, the conicity of the bole need no longer be considered whereby it is no longer necessary to provide for a separate control of the servomotors for the supports 9 and 10 and/or for a switchover or changeover of corresponding gear systems. Furthermore, a light barrier is no longer required, either, determining the head diameter D of the bole for calculating the height of the support 9.

It is, of course, also possible, in accordance with an embodiment that is not illustrated, to replace the support 10 for the tail-side end by a support designed essentially like the head-side support illustrated in FIG. 9 wherein the rollers 35 and 43 can be replaced by clamping jaws, and the diameter d of the tail end can simultaneously be determined by the clamping jaws 35 and 43.

If the tail-side diameter d is determined by a device with clamping jaws 35 and 43 corresponding to the device shown in FIG. 9, then the stroke of the support bearings 41 at the tail end and at the head end can be coupled directly with the feed of the support 9 or, respectively, the slide 42 at the tail end since the height H of the heart zone is proportional to the diameter d of the bole 2 and, respectively, to the value S.

Instead of a roller or clamping jaw 43, it is also possible to provide at the slide 42, for example, two rollers and/or clamping jaws 43 arranged in the shape of a V whereby the operating accuracy of the device according to this invention is further enhanced.

The above-described arrangement can also be designed with manual control. The structure in this case is analogous to the one illustrated in FIGS. 5 and 6. However, the device for light measurement, the computer, and the displacement transducer are omitted. The adjustability of the upper milling roll 5 and of the synchronously operating, perpendicular milling rolls 12, 13, as well as of the supports 9 and 10 on the head and base side by means of adjusting motors 18 and 23 is unchanged. The operator estimates, at the entering bole, the tail thickness D and/or the lateral length S of the square to be obtained therefrom, and sets, by pressing a button, the servomotors for the upper 5 and the two perpendicular milling rolls 12, 13 to the estimated value S, the respectively set value being displayed on a measuring scale or by way of a screen. With a second operating button, the servomotor 18 for the head-side support 9 is operated, and the latter is shifted in its vertical position until the upper and lower h values are approximately equal (FIG. 2). This adjustment can be rather accurately estimated by optical perception. The adjustment control of the support 10 on the top side is coupled with the adjustment control on the foot side. The height ratio of the two supports is determined by the conicity of the bole 2; this conicity can be assumed to extend approximately uniformly through a specific type of wood. The level difference of the supports 9 and 10 can thus be introduced as a fixed value dependent on the length of the log. The ratio h':h (in connection with FIG. 2), based on a specific length, is, for example, 1:6, i.e. the servomotor 23 of the support 10 on the top side of the bole is permitted to advance only by 1 cm when the head-side support 9 moves by 6 cm. This transmission ratio can be fixed by the choice of various spindle pitches and/or gear transmissions. The slight differences in height resulting from the varying lengths can be compensated for by changing the speed of revolution of the servomotor on the top side, for example by using series-wound motors with speed variability. All of the remaining functions, such as slide guidance and returning thereof by adjustable stop 34 on the rails 32, as well as also the arrangement on the outlet side, remain unchanged. By means of this simple design, controlled by two push buttons, it is likewise feasible to obtain high throughput efficiencies with a trained operator. However, skilled personnel is needed for the operation since the estimation of the top end thickness requires a certain experience.

What is claimed is:

1. Process for the production of a beam of rectangular cross section from a tree bole that is larger at one end than at the other end, comprising measuring both ends of the bole, supporting both ends of the bole in positions determined by the measurement of the ends of the bole, and moving the thus-supported bole in a direction parallel to the heart zone of the bole past cutting means that cut plano-convex slabs from the bole leaving four sides on the beam each of which extends parallel to said heart zone of the bole.

2. Process according to claim 1, wherein said planes intersect the smaller end of the bole in a square.

3. Process according to claim 1, comprising conducting the cutting operation in two successive steps, the first of said steps comprising advancing the bole by means of an entrainment member engaging said small end, and the second of said steps comprising advancing the bole while supporting an underside of a flat forward end of the beam on a conveyor.

4. Process according to claim 1, and effecting said cutting by moving the bole past opposed pairs of milling rolls.

5. Process according to claim 1, wherein said measuring is of the diameter of the ends of the bole, the measurements of diameters being effected photoelectrically.

6. Apparatus for cutting a beam of rectangular cross section from a tree bole that is larger at one end than at the other end, comprising means for measuring opposite ends of the bole, height-adjusting support means for individually supporting opposite ends of the bole at individually selected elevations, means for adjusting the height of the support means in accordance with the measurement of the opposite ends of the bole, means for cutting plano-convex slabs from four sides of the bole to leave a beam of rectangular cross section, and means for moving said supporting means relative to said cutting means in a direction parallel to the heart zone of the bole, whereby the cutting means cut said plano-convex slabs from the bole along cutting planes that are all parallel to said heart zone of the bole.

7. Apparatus as claimed in claim 6, wherein said cutting means are milling rolls disposed on opposite sides of the bole.

8. Apparatus as claimed in claim 6, wherein said moving means comprises a gripper for gripping the end of the bole farthest from the cutting means toward which the bole is advanced.

9. Apparatus according to claim 8, and means mounting the gripper for sliding movement along horizontal rails.

10. Apparatus according to claim 9, and stop means for limiting said sliding movement of said gripper along said rails.

11. Apparatus according to claim 6, wherein said support means for the end of the bole nearest the cutting means toward which the bole is advanced comprise rollers for rollingly supporting the bole.

12. Apparatus according to claim 6, and conveyor means for supporting a finished flat bottom surface of the beam cut from the bole, said conveyor means having an upper supporting surface coincident with the plane of the lower surface of the beam and parallel to said direction of movement.

13. Apparatus according to claim 12, and a hold-down having rollers mounted on a rocker arm articulated to a lever carrying a counterweight, said hold-down being so positioned as to engage an upper surface of the beam on the conveyor.

14. Apparatus according to claim 6, wherein said support means for the end of the bole nearest said cutting means contacts the bole on opposite vertical sides of the bole.

15. Apparatus according to claim 14, and means for moving the last-named support means on opposite sides of the bole simultaneously in the same direction parallel to the heart zone of the bole.

16. Apparatus according to claim 14, wherein said support means nearest the cutting means include at least one roller in contact with the bole.

17. Apparatus according to claim 14, wherein said support means nearest the cutting means includes clamping means for clamping the bole.

* * * * *